US007841307B2

(12) United States Patent
Itoga et al.

(10) Patent No.: US 7,841,307 B2
(45) Date of Patent: Nov. 30, 2010

(54) COOLING FAN DRIVE SYSTEM FOR TRAVEL TYPE WORKING MACHINE

(75) Inventors: Kentarou Itoga, Tsukuba (JP); Tsuyoshi Nakamura, Tsuchiura (JP); Kazunori Nakamura, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 220 days.

(21) Appl. No.: 11/909,325

(22) PCT Filed: Oct. 24, 2006

(86) PCT No.: PCT/JP2006/321163

§ 371 (c)(1),
(2), (4) Date: Sep. 21, 2007

(87) PCT Pub. No.: WO2007/052495

PCT Pub. Date: Oct. 5, 2007

(65) Prior Publication Data

US 2009/0025661 A1 Jan. 29, 2009

(30) Foreign Application Priority Data

Nov. 2, 2005 (JP) ..... 2005-320131

(51) Int. Cl.
*F01P 7/02* (2006.01)

(52) U.S. Cl. ..... 123/41.12; 123/41.49

(58) Field of Classification Search ..... 123/41.12, 123/41.49

See application file for complete search history.

(56) References Cited

U.S. PATENT DOCUMENTS 4,823,744 A * 4/1989 Omura ..... 123/41.12
6,349,882 B1 2/2002 Kita et al.

FOREIGN PATENT DOCUMENTS

| | | |
|---|---|---|
| JP | 1-170711 A | 7/1989 |
| JP | 2000-110560 | 4/2000 |
| JP | 2000-303837 | 10/2000 |
| JP | 2001-182535 | 7/2001 |
| JP | 2002-357126 A | 12/2002 |
| JP | 2004-176591 | 6/2004 |
| JP | 2004-197681 A | 7/2004 |
| JP | 2005-69203 A | 3/2005 |

* cited by examiner

*Primary Examiner*—Noah Kamen
(74) *Attorney, Agent, or Firm*—Mattingly & Malur, P.C.

(57) ABSTRACT

In a cooling fan drive system for a travel type working machine, the rotational speed of a cooling fan is controlled to the optimum rotational speed in accordance with temperature increase of the temperature of an engine cooling water, and the engine rotational speed is smoothly increased when the engine rotational speed is increased under travel acceleration. A fourth fan target rotational speed calculator 35*e* and a minimum value selector 35*f* are provided, and under non-operation, the fan target rotational speed is set to a low rotational speed irrespective of the temperature. When an acceleration pedal 12 is depressed to increase the rotational speed of the engine under travel acceleration, the increase of the drive pressure of a hydraulic motor 23 due to increase of the rotation of the cooling fan 9 is suppressed, and the load on the engine 1 is reduced.

13 Claims, 8 Drawing Sheets

COOLING FAN DRIVE SYSTEM FOR TRAVEL TYPE WORKING MACHINE

TECHNICAL FIELD

The present invention relates to a cooling fan drive system for a travel type working machine including a load working vehicle such as a wheel loader, a telehandler or the like, a construction machine such as a wheel type hydraulic shovel, and a crawler type hydraulic shovel or the like.

BACKGROUND ART

In a traveling type working machine such as a wheel loader or the like which is representative of a load working vehicle, a hydraulic pump and a torque-converter are driven by an engine to thereby drive respective working machines and track devices.

The engine is cooled by circulating a coolant (engine cooling water) to the main body of the engine. The coolant heated in the engine is passed through a radiator to be cooled, and then returned to the engine. Furthermore, the hydraulic pump and the torque-converter require hydraulic operating fluid. The hydraulic operating fluid is cooled by leading the hydraulic operating fluid to respective oil coolers.

The radiator and the oil cooler are cooled by air produced by a cooling fan. In general, the cooling fan is secured to an engine driving shaft and directly rotated by the engine. Furthermore, in consideration of a layout problem or a noise problem, a method of driving the cooling fan while the cooling fan is separated from the engine has been adopted.

For example, in JP, A 2000-303837, the cooling fan is driven by a hydraulic motor. In this case, the hydraulic motor is driven by the hydraulic fluid delivered by a hydraulic pump, and the hydraulic pump is driven by an engine. Furthermore, in JP, A 2000-303837, a coolant temperature and a hydraulic operating fluid temperature are detected, and the rotational speed of the cooling fan is controlled to the optimum rotational speed in accordance with these temperatures, whereby the cooling fan is driven at the optimum energy efficiency and the noise is controlled to the minimum level. The hydraulic pump is a variable displacement hydraulic pump, and the tilting angle of the hydraulic pump is controlled to vary the displacement volume (capacity) of the hydraulic pump, whereby the delivery capacity of the hydraulic pump is varied to control the rotational speeds of the hydraulic motor and the cooling fan.

Patent Document 1: JP, A 2000-303837

DISCLOSURE OF THE INVENTION

Problem to be Solved by the Invention

However, the above prior art has the following problem.

In the above prior art, when the temperatures of the hydraulic operating fluid and the coolant are high, the target rotational speed of the cooling fan is set to a high value, and the tilting angle or the displacement volume (capacity) of the hydraulic pump is controlled to a large value in accordance with the target rotational speed. Therefore, when the acceleration pedal is depressed to increase travel acceleration from the state that the temperatures of the hydraulic operating fluid and the coolant are high, the tilting angle or the displacement volume (capacity) of the hydraulic pump is large, and the increasing rate of the delivery rate of the hydraulic pump is large due to an increase in the rotational speed of the engine. Accordingly, the driving force of the hydraulic motor connected to the cooling fan (the delivery pressure of the hydraulic pump) is greatly increased, and thus the engine load is increased when the rotational speed of the engine increase and the spewing of the engine (the increasing speed of the rotation of the engine) worsens. This causes a reduction in travel acceleration performance and a reduction in the speed of the working machines. Furthermore, there is a problem that exhaust gas worsens and the environment is polluted.

An object of the invention is to provide a cooling fan drive system for a working machine that can control the rotational speed of a cooling fan to the optimum rotational speed in accordance with an increase in the temperature of the engine coolant, and smoothly increase the rotational speed of the engine when the rotational speed of the engine increases for travel acceleration.

Means of Solving the Problem (1) In order to attain the above object, there is provided a cooling fan drive system for a travel type working machine including a cooling fan for cooling an engine coolant, a hydraulic pump driven by an engine, and a hydraulic motor actuated by a hydraulic fluid delivered by the hydraulic pump for rotating the cooling fan, wherein the cooling fan drive system comprises: temperature detecting means for detecting the temperature of the engine coolant; rotational speed detecting means for detecting the rotational speed of the engine; and cooling fan control means for controlling the rotational speed of the hydraulic motor on the basis of the detection values of the temperature detecting means and the rotational speed detecting means so that the rotational speed of the cooling fan is increased as the temperature of the engine coolant rises up and the increase of the rotational speed of the cooling fan is limited when the rotational speed of the engine increases.

With the above structure, when the temperature of the engine coolant increases under a stationary driving state such as a stationary travel state where the engine rotates at a relatively high speed or the like, the cooling fan control means controls the rotational speed of the cooling fan to the optimum rotational speed in accordance with the temperature increase of the engine coolant, so that the engine cooling water is properly cooled owing to increase of cooling air generated by the cooling fan and thus the temperature increase of the engine coolant can be suppressed. Furthermore, when the rotational speed of the engine increases due to travel acceleration or the like, the cooling fan control means controls the rotational speed of the hydraulic motor so as to restrict the increase of the rotational speed of the cooling fan. Therefore, increase of the driving pressure of the hydraulic motor (the delivery pressure of the hydraulic pump) can be suppressed, and thus the load of the engine when the rotational speed of the engine increases is lowered, so that the rotational speed of the engine can smoothly increase.

(2) In the foregoing (1), it is preferable that the cooling fan control means calculates a fan target rotational speed that increases as the temperature of the engine coolant rises up, calculates a limiting value of the fan target number that decreases as the rotational speed of the engine decreases, corrects the fan target rotational speed so that the fan target rotational speed does not exceed the limiting value, and controls the rotational speed of the hydraulic motor so as to achieve the corrected fan target rotational speed.

The cooling fan control means described above increases the rotational speed of the cooling fan as the temperature of the engine coolant increases, and controls the rotational speed of the hydraulic motor so as to restrict the increase of the rotational speed of the cooling fan because the limiting value of the fan target rotational speed is reduced when the rotational speed of the engine increases.

(3) In the foregoing (1), the rotational speed detecting means may have means for detecting the target rotational speed of the engine and means for detecting the actual rotational speed of the engine, and the cooling fan control means may calculate the fan target rotational speed that increases as the temperature of the engine coolant rises up, calculate the limiting value of the fan target rotational speed that is lowered as the rotational speed difference between the target rotational speed and the actual rotational speed of the engine increases, correct the fan target rotational speed so that the fan target rotational speed does not exceed the limiting value, and control the rotational speed of the hydraulic motor so as to achieve the corrected fan target rotational speed.

Accordingly, the cooling fan control means increases the rotational speed of the cooling fan as the temperature of the cooling water rises up, and controls the rotational speed of the hydraulic motor so as to restrict the increase of the rotational speed of the cooling fan because the limiting value of the fan target rotational speed is lowered when the rotational speed difference of the engine is increased when the rotational speed of the engine increases.

(4) In the foregoing (1), it is preferable that the hydraulic pump is a variable displacement hydraulic pump, and the cooling fan control means controls the rotational speed of the hydraulic motor by controlling the delivery capacity of the hydraulic pump.

(5) In the foregoing (1), the hydraulic motor may be a variable displacement hydraulic motor, and the cooling fan control means may control the rotational speed of the hydraulic motor by controlling the delivery capacity of the hydraulic motor.

(6) The foregoing (1) may be further equipped with a bypass circuit that is branched from a hydraulic fluid supplying line for supplying the hydraulic fluid delivered by the hydraulic pump to the hydraulic motor and connects the hydraulic fluid supplying line to a tank, wherein the cooling fan control means controls the rotational speed of the hydraulic motor by controlling a bypass flow rate flowing in the bypass circuit.

(7) Furthermore, in order to attain the above object, there is provided a cooling fan drive system for a travel type working machine having an engine and a hydraulic pump of a working hydraulic system driven by the engine, the cooling fan drive system including a cooling fan for cooling a cooling water of the engine and a hydraulic fluid of the working hydraulic system, a hydraulic pump driven by the engine, and a hydraulic motor actuated by the hydraulic fluid delivered by the hydraulic pump for rotating the cooling fan, wherein the cooling fan drive system comprises: first temperature detecting means for detecting the temperature of the engine coolant; second temperature detecting means for detecting the temperature of the hydraulic fluid of the working hydraulic system; rotational speed detecting means for detecting the rotational speed of the engine; and cooling fan control means for controlling the rotational speed of the hydraulic motor on the basis of the detection values of the first and second temperature detecting means and the rotational speed detecting means so that the rotational speed of the cooling fan is increased as any one of the temperature of the coolant and the hydraulic fluid of the working hydraulic system increases, and the increase of the rotational speed of the cooling fan is limited when the rotational speed of the engine increases.

(8) Further, in order to attain the above object, there is provided a cooling fan drive system for a travel type working machine having an engine, a hydraulic pump of a working hydraulic system driven by the engine and a travel device driven through a torque converter by the engine, said cooling fan drive system including a cooling fan for cooling a cooling water of the engine, a hydraulic fluid of the working hydraulic system and an operating oil of the torque converter, a hydraulic pump driven by the engine and a hydraulic motor actuated by the hydraulic fluid delivered by the hydraulic pump for rotating the cooling fan, wherein said cooling fan drive system comprises: first temperature detecting means for detecting the temperature of the coolant; second temperature detecting means for detecting the temperature of the hydraulic fluid of the working hydraulic system; third temperature detecting means for detecting the temperature of the operating oil of the torque converter; rotational speed detecting means for detecting the rotational speed of the engine; and cooling fan control means for controlling the rotational speed of the hydraulic motor on the basis of the detection values of the first, second and third temperature detecting means and the rotational speed detecting means so that the rotational speed of the cooling fan is increased as any one of the temperature of the coolant, the hydraulic fluid of the working hydraulic system and the operating oil of the torque converter increases and the increase of the rotational speed of the cooling fan is limited when the rotational speed of the engine increases.

ADVANTAGE OF THE INVENTION

Accordingly, the rotational speed of the cooling fan is controlled to the optimum rotational speed in accordance with the temperature increase of the engine coolant, and also the rotational speed of the engine can be smoothly increased when the rotational speed of the engine under travel acceleration is increased. As a result, the working efficiency can be enhanced, and also there is little deterioration of exhaust gas, so that there is little concern about environmental pollution.

DESCRIPTION OF THE REFERENCE NUMERALS AND SIGNS

Figure 1:
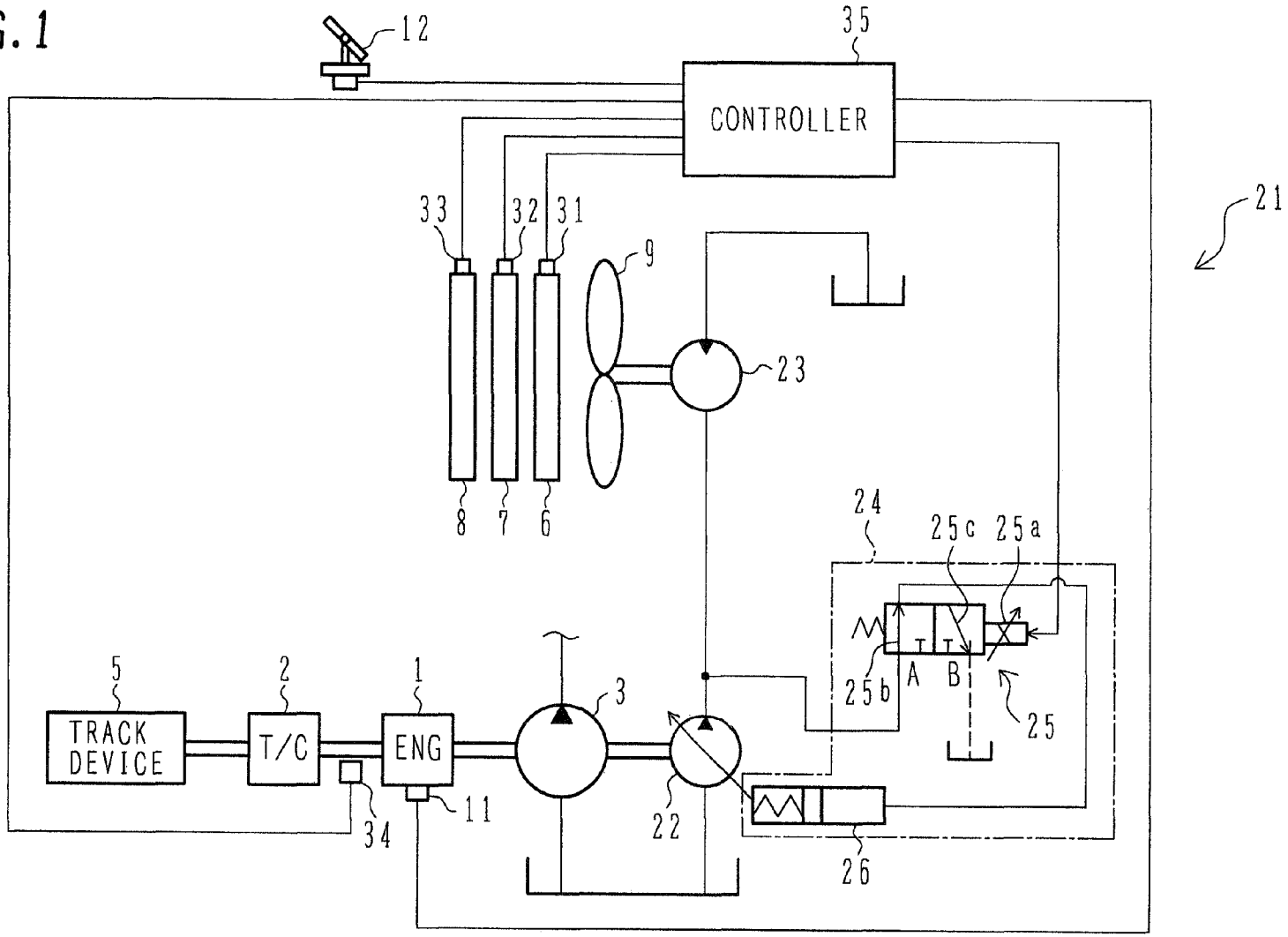
FIG. 1 is a diagram showing a cooling fan drive system for a travel type working machine according to an embodiment of the invention together with the surrounding construction thereof.

1 engine
2 torque converter
3 hydraulic pump
5 travel device
6 radiator
7 oil cooler (for hydraulic fluid of hydraulic system)
8 oil cooler (for operating oil of torque converter)
9 cooling fan
11 electronic governor
12 acceleration pedal
21 cooling fan drive system
21A cooling fan drive system
21B cooling fan drive system
22 hydraulic pump (variable displacement type)
23 hydraulic motor (fixed displacement type)
24 regulator
25 solenoid control valve
25*a* solenoid
25*b* first hydraulic line
25*c* second hydraulic line
26 tilting actuator
31, 32, 33 temperature sensor
34 rotational speed sensor
35 controller
35A controller
35B controller
35C controller
35*a* first fan target rotational speed calculator
35*b* second fan target rotational speed calculator
35*c* third fan target rotational speed calculator
35*d* maximum value selector
35*e* fourth fan target rotational speed calculator
35*f* minimum value selector
35*g* pump tilting angle calculator
35*h* control current calculator
35*i* fourth fan target rotational speed calculator
35*j* motor tilting angle calculator
35*k* bypass flow amount calculator
44 regulator
45 solenoid control valve
45*a* solenoid
46 tilting actuator
51 hydraulic fluid supply line
52 bypass hydraulic line
54 bypass circuit
55 solenoid control valve
56 tank hydraulic line

BEST MODES FOR CARRYING OUT THE INVENTION

Embodiments of the invention will be described hereunder with reference to the drawings.

FIG. 1 is a diagram showing a cooling fan drive system for a travel type working machine according to a first embodiment of the invention together with the surrounding construction thereof.

In FIG. 1, the travel type working machine according to this embodiment has a diesel engine as a motor (hereinafter referred to as the engine") 1, a torque converter 2 and a hydraulic pump 3 which are driven by the engine 1. The torque converter 2 is linked to the travel device 5, and the driving force of the engine 1 is transmitted through the torque converter 2 to the travel device 5. The travel device 5 has a transmission, a differential gear, an axle, front wheels, rear wheels, etc. (not shown), and drives the front wheels and the rear wheels by the driving force of the engine 1 transmitted through the torque converter 2, thereby generating traveling force. The hydraulic pump 3 is rotationally driven by the engine 1, and delivers a hydraulic fluid. The hydraulic fluid is supplied to a hydraulic actuator for working through a control valve (not shown), and drives a working machine (described later).

The engine 1 is cooled by circulating engine cooling water (coolant) to the main body of the engine. The coolant heated in the engine 1 is passed through a radiator 6 to be cooled and then returned into the engine 1. Furthermore, the hydraulic pump 3 and the torque converter 2 require hydraulic operating fluid. The cooling of these hydraulic operating fluids is carried out by leading the hydraulic operating fluid to oil coolers 7 and 8. The radiator 6 and the oil coolers 7, 8 are cooled by air flow generated by the cooling fan 9.

The engine 1 is equipped with an electronic governor (fuel injection device) 11, and the electronic governor 11 adjusts the fuel injection amount in accordance with the operation (acceleration amount) of the acceleration pedal 12 to thereby adjust the rotational speed of the engine 1. The acceleration pedal 12 is operated by an operator, and a target engine rotational speed (hereinafter referred to as target rotational speed) is instructed in accordance with an amount of pressure applied thereon (acceleration amount).

The travel type working machine as described above is equipped with a cooling fan drive system 21. The cooling fan drive system 21 is equipped with a hydraulic pump 22 driven by the engine 1, and a hydraulic motor 23 that is actuated by the hydraulic fluid delivered by the hydraulic pump 22 to rotate the cooling fan 9. The hydraulic pump 22 is a variable displacement type hydraulic pump, and the hydraulic motor 23 is a fixed displacement type hydraulic motor. The displacement volume (capacity) of the hydraulic pump 22 is controlled by varying the tilting angle of the swash plate of the hydraulic pump 22 (hereinafter referred to as tilting angle or tilting) by a regulator 24. The regulator 24 has a solenoid control valve 25 and a tilting actuator 26.

The solenoid control valve 25 is located at a first position A as shown in FIG. 1 when a control current given by a solenoid 25*a* is equal to zero, and it is moved from the first position A to a second position B as the control current increases. When the control current is at a maximum, the solenoid control valve 25 is switched to the second position B. When the solenoid control valve 25 is set to the first position A to the left, the opening area of a first hydraulic line 25*b* for connecting the hydraulic pump 22 and the tilting actuator 26 is at a maximum, a second hydraulic line 25*c* for connecting the tilting actuator 26 and the tank is closed, and the driving pressure of the tilting actuator 26 is set to the maximum pressure (the delivery pressure of the hydraulic pump 22). Accordingly, the tilting actuator 26 controls the tilting angle of the hydraulic pump 22 so that the displacement volume (capacity) is at a minimum, and sets the delivery flow rate of the hydraulic pump 22 to the minimum value. When the solenoid control valve 25 is switched to the second position B at the right side of the figure, the first hydraulic line 25*b* is closed, the opening area of the second hydraulic line 25*c* is set to the maximum value, and the driving pressure of the tilting actuator 26 is set to the lowest pressure (tank pressure).

Accordingly, the tilting actuator 26 controls the tilting angle of the hydraulic pump 22 so that the displacement volume (capacity) of the hydraulic pump 22 is at a maximum, and sets the delivery flow rate of the hydraulic pump 22 to the maximum value. The opening area of the first hydraulic line 25*b* is reduced as the solenoid control valve is moved from the first position A to the second position B, the opening area of the second hydraulic line 25*c* is increased, and the driving pressure of the tilting actuator 26 is set to the pressure corresponding to the stroke position of the solenoid control valve 25 (the control current given to the solenoid 25*a*). Accordingly, the tilting actuator 26 controls the tilting angle of the hydraulic pump 22 so that the displacement volume (capacity) of the hydraulic pump 22 increases in accordance with the stroke position of the solenoid control valve 25 (the magnitude of the control current given to the solenoid 25*a*), thereby controlling the delivery flow rate of the hydraulic pump 22 in accordance with the controlled tilting angle of the hydraulic pump 22.

The radiator 6 is provided with a temperature sensor 31 for detecting the temperature of the engine coolant (coolant), and the oil cooler 7 is provided with a temperature sensor 32 for detecting the temperature of the hydraulic fluid used in a working hydraulic system containing the hydraulic pump 3 (hereinafter properly referred to as hydraulic-system hydraulic operating fluid). The oil cooler 8 is provided with a temperature sensor 33 for detecting the temperature of the hydraulic operating fluid of the torque converter 2 (hereinafter properly referred to as torque-converter hydraulic operating fluid), and the engine 1 is provided with a rotational speed sensor 34 for detecting the rotational speed of the engine. Detection signals of these sensors 31 to 34 are input to the controller 35, and the controller 35 executes predetermined calculation processing on the basis of these input signals and outputs the control current to the solenoid of the solenoid control valve 26. The controller 35 also serves as an engine controller, and it receives an instruction signal of the acceleration pedal 12 to execute predetermined calculation processing and outputs a control signal to the electronic governor 11.

Figure 2:
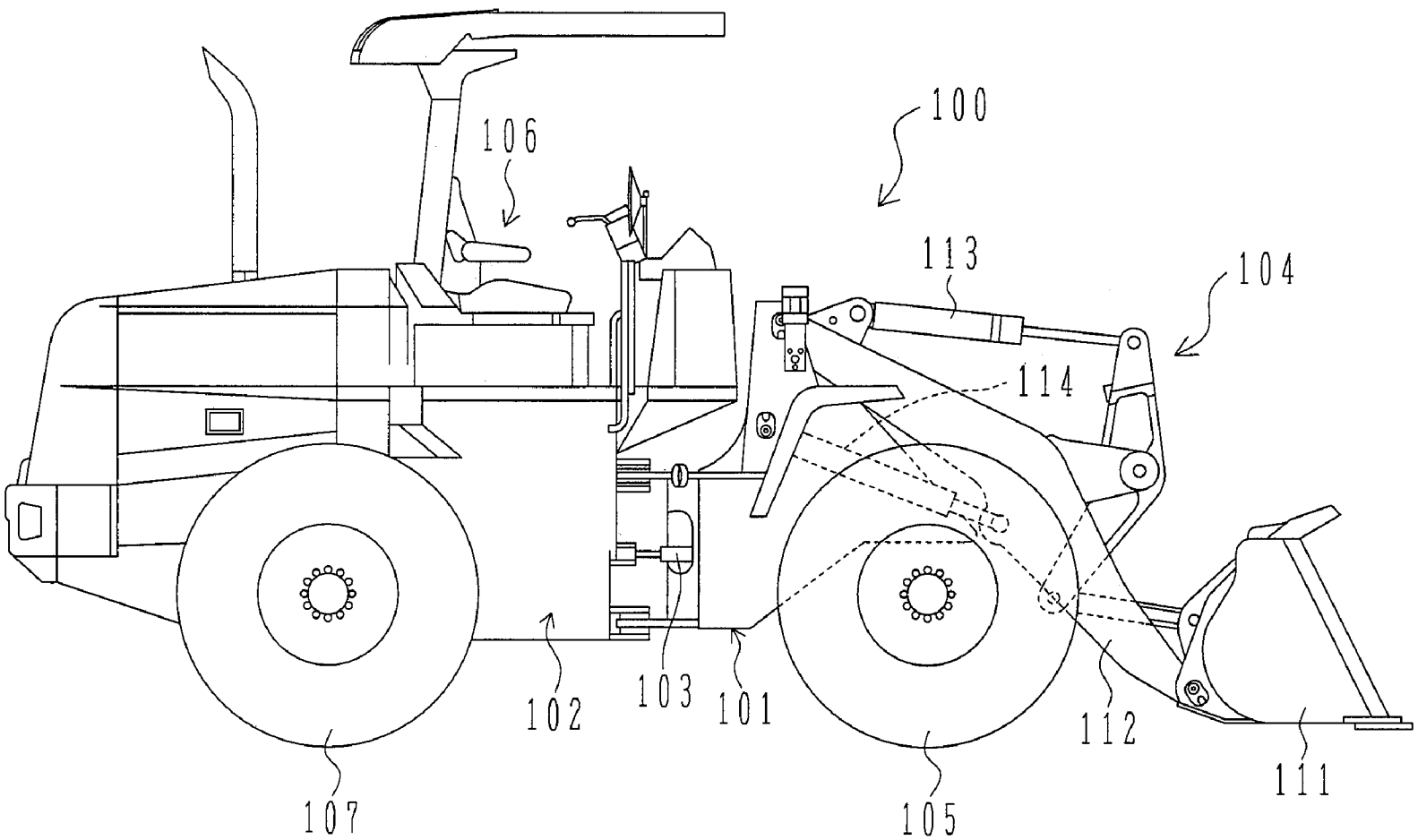
FIG. 2 is a diagram showing the outlook of a wheel loader as an example of a traveling working vehicle in which the cooling fan drive system of the invention is mounted.

FIG. 2 is a diagram showing the outlook of a wheel loader as an example of the travel working vehicle in which the cooling fan drive system 21 shown in FIG. 1 is mounted.

In FIG. 2, 100 represents the wheel loader, and in the wheel loader 100, the vehicle body comprises a vehicle body front portion 101 and a vehicle body rear portion 102. The vehicle body front portion 101 and the vehicle body rear portion 102 are linked to each other so as to be freely and relatively rotatable so that the posture of the vehicle body front portion 101 is varied with respect to the vehicle body rear portion 102 by a steering cylinder 103. The vehicle body front portion 101 is provided with a working machine 104 and front wheels 105, and the vehicle body rear portion 102 is provided with a driving seat 106 and rear wheels 107. The working machine 104 comprises a bucket 111 and a lift arm 112. The bucket 111 carries out a tilting and dumping operation through expansion and contraction of a bucket cylinder 113, and the lift arm 112 operates vertically through expansion and contraction of an arm cylinder 114.

The steering cylinder 103, the bucket cylinder 113 and the arm cylinder 114 are driven by the hydraulic fluid delivered by the hydraulic pump 3 shown in FIG. 1. The front wheels 105 and the rear wheels 107 constitute a part of the travel device 5 shown in FIG. 1, and are driven by the driving force of the engine 1 transmitted through the torque converter 2. The acceleration pedal 12 and an operating lever device (not shown) are provided to the floor of the driving seat 106, and the main devices such as the engine 1, the hydraulic pumps 3, 22, the controller 35, etc. are mounted at the vehicle body rear portion 102.

Figure 3:
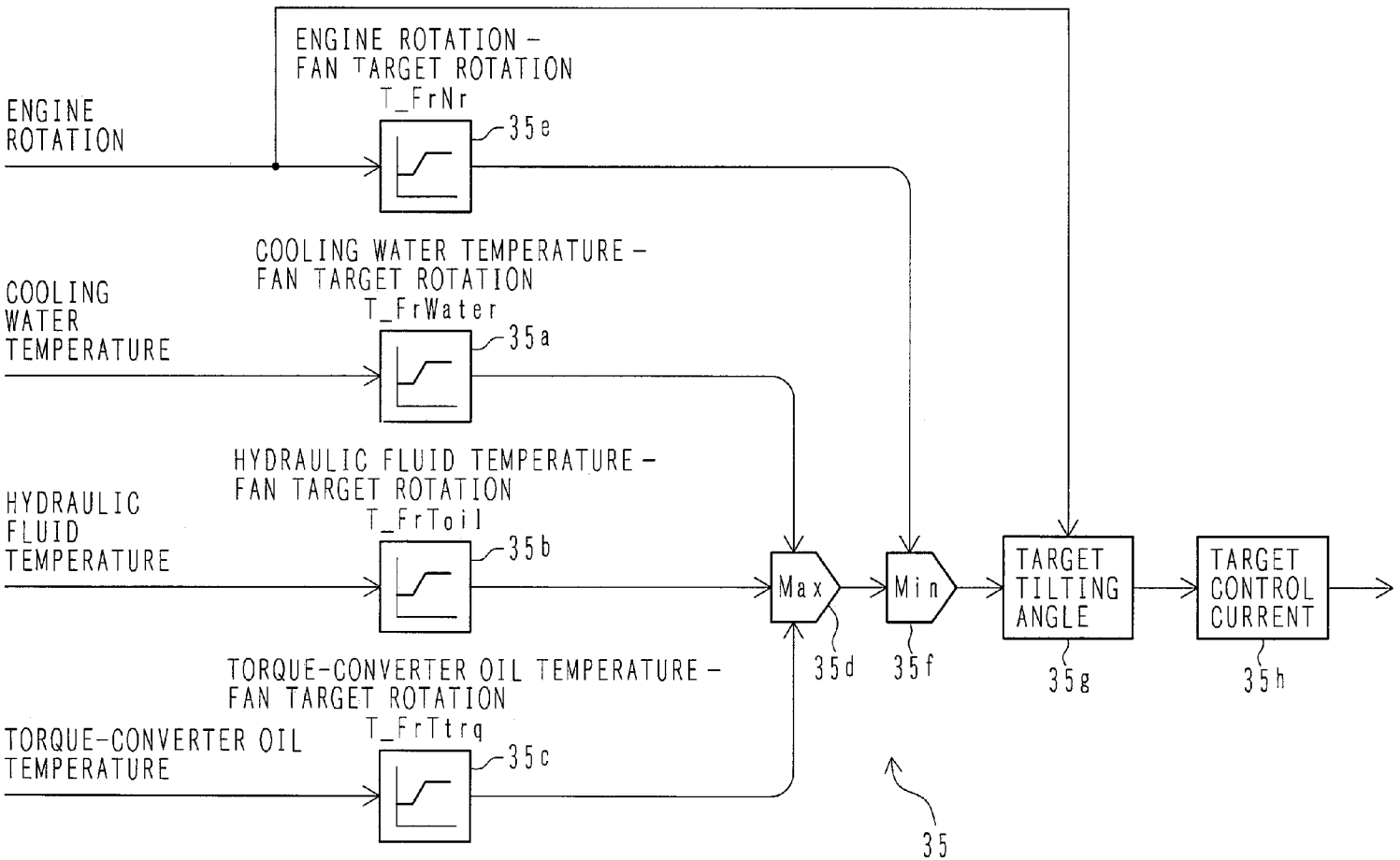
FIG. 3 is a functional block showing a processing function of a controller which is associated with the cooling fan drive system.

FIG. 3 is a functional block diagram showing the processing function of the controller 35 which are associated with the cooling fan drive system.

In FIG. 3, the controller 35 has the respective functions of the first fan target rotational speed calculator 35*a*, the second fan target rotational speed calculator 35*b*, the third fan target rotational speed calculator 35*c*, the maximum value selector 35*d*, the fourth fan target rotational speed calculator 35*e*, the minimum value selector 35*f*, the pump tilting angle calculator 35*g* and the control current calculator 35*h*.

The first fan target rotational speed calculator 35*a* receives the temperature (cooling water temperature) of the engine coolant (coolant) detected by the temperature sensor 31 and refers to a table stored in a memory to calculate the fan target rotational speed corresponding to the cooling water temperature concerned. In the table of the memory is set the relationship between the cooling water temperature and the fan target rotational speed in which the fan target rotational speed increases as the cooling water temperature increases.

The second fan target rotational speed calculator 35*b* receives the temperature of the hydraulic operating fluid (referred to as hydraulic operating fluid temperature) used in the hydraulic pump 3, etc. which is detected by the temperature sensor 32, and refers to a table stored in a memory to calculate the fan target rotational speed corresponding to the hydraulic operating fluid at that time. In the memory of the table is set the relationship between the hydraulic operating fluid temperature and the fan target rotational speed in which the fan target rotational speed increases as the hydraulic operating fluid temperature increases.

The third fan target rotational speed calculator 35*c* receives the temperature of the operation oil used in the torque converter 2 (referred to as torque-converter oil) detected by the temperature sensor 33, and refers to a table stored in a memory to calculate the fan target rotational speed corresponding to the torque-converter oil temperature at that time. In the table of the memory is set the relationship between the torque-converter oil temperature and the fan target rotational speed in which the fan target rotational speed increases as the torque-converter oil temperature increases.

The maximum value selector 35*d* selects the highest rotational speed among the fan target rotational speed calculated in the first fan target rotational speed calculator 35*a*, the fan target rotational speed calculated in the second fan target rotational speed calculator 35*b* and the fan target rotational speed calculated in the third fan target rotational speed calculator 35*c*.

The fourth fan target rotational speed calculator 35*e* receives the rotational speed of the engine 1 detected by the rotational speed sensor 34 (referred to as engine rotational speed) and refers to a table stored in a memory to calculate the fan target rotational speed corresponding to the engine rotational speed at that time. In the table of the memory is set the relationship between the engine rotational speed and the fan target rotational speed in which the fan target rotational speed increases as the engine rotational speed increases.

The minimum value selector 35*f* selects the smaller rotational speed out of the fan target rotational speed selected in the maximum value selector 35 and the fan target rotational speed calculated in the fan target rotational calculator 35*e*.

Here, the selection of the smaller rotational speed out of the fan target rotational speed selected in the maximum value selector 35 and the fan target rotational speed calculated in the target rotational speed calculator 35*e* by the minimum value selector 35*f* means that when the fan target rotational speed selected in the maximum value selector 35*d* is smaller than the fan target rotational speed calculated in the fan target rotational speed calculator 35*e*, the latter fan target rotational speed is selected, and when the fan target rotational speed selected in the maximum value selector 35*d* is larger than the fan target rotational speed calculated in the fan target rotational speed calculator 35*e*, the former fan target rotational speed is selected. As a result, in the minimum value selector 35*f*, the fan target rotational speed calculated in the fourth fan target rotational speed calculator 35*e* is set as a limiting value, and the fan target rotational speed is corrected so that the fan target rotational speed selected in the maximum value selector 35*d* does not exceed the limiting value. Furthermore, in the fourth fan target rotational speed calculator 35*e*, the limiting value of the fan target rotational speed which is lowered as the engine rotational speed decreases is calculated.

The pump tilting angle calculator 35*g* calculates the target tilting angle of the hydraulic pump 22 for achieving the fan target rotational speed from the rotational speed of the engine 1 detected by the rotational speed sensor 34 and the fan target rotational speed selected in the minimum value selector 35*f*.

Here, the rotational speed of the fan 9 is equal to the rotational speed of the hydraulic motor 23, and determined on the basis of the flow rate of the hydraulic fluid flowing in the hydraulic motor 23. The flow rate of the hydraulic fluid flowing in the hydraulic motor 23 is equal to the delivery flow rate of the hydraulic pump 22, and the delivery flow rate of the hydraulic pump 22 is determined by the tilting angle and rotational speed of the hydraulic pump 22. The rotational speed of the hydraulic pump 22 is determined by the rotational speed of the engine 1. Accordingly, if the rotational speed of the engine 1 is known, the target tilting angle of the hydraulic pump 22 to achieve the fan target rotational speed could be calculated.

The control current calculator 35*h* calculates the target control current of the solenoid 25*a* of the solenoid control valve 25 to achieve the target tilting angle calculated in the pump tilting angle calculator 35*g*.

The controller 35 generates the control current corresponding to the thus-determined target control current, and outputs the control current to the solenoid 25*a* of the solenoid control valve 25.

The regulator 24 of the hydraulic pump 22 and the respective functions of the first fan target rotational speed calculator 35*a*, the second target rotational speed calculator 35*b*, the third fan target rotational speed calculator 35*c*, the maximum value selector 35*d*, the fourth fan target rotational speed calculator 35*e*, the minimum value selector 35*f*, the pump tilting angle calculator 35*g* and the control current calculator 35*h* of the controller 35 constitute the cooling fan control means for controlling the rotational speed of the hydraulic motor 23 on the basis of the detection values of the temperature sensors 31 to 33 (temperature detecting means) and the rotational speed sensor 34 (rotational speed detecting means) so as to increase the rotational speed of the cooling fan 9 according to the temperature of the coolant increases and also so as to limit the increase of the rotational speed of the cooling fan 9 when the rotational speed of the engine is increased due to the increase of the target rotational speed of the engine 1.

Furthermore, the cooling fan control means calculates the fan target rotational speed which increases as the temperature of the coolant increases, calculates the limiting value of the fan target rotational speed which decreases as the rotational speed of the engine decreases, corrects the fan target rotational speed so that the fan target rotational speed does not exceed the limiting value, and controls the rotational speed of the hydraulic motor 23 so as to achieve the corrected fan target rotational speed.

Next, the operation of the cooling fan drive system constructed as described above will be described.

<Under Stationary Operation>

First, a stationary operation state under which the acceleration pedal 12 is fully depressed and the engine 1 is rotated at high speed will be described. The stationary operation contains a traveling operation when the wheel loader is shifted to another place, an excavating operation of driving the bucket into the ground by traveling traction force, travel movement after the excavation, a work such as throw-out of soil, etc.

Under such stationary operation, when the temperature of the engine coolant (cooling water temperature) increases, a high fan target rotational speed is calculated in accordance with the cooling water temperature in the first fan target rotational speed calculator 35*a* of the controller 35, and the fan target rotational speed concerned is selected in the maximum value selector 35*d*. Furthermore, the acceleration pedal 12 is fully depressed and the engine 1 is rotated at high-speed (for example, the maximum rotational speed), a high fan target rotational speed (for example, the maximum fan target rotational speed) is calculated in accordance with the engine rotational speed in the fourth fan target rotational speed calculator 35*e*, and the high fan target rotational speed selected in the maximum value selector 35*d* is selected in the minimum value selector 35*f*. In the pump tilting angle calculator 35*g*, a large target tilting angle (for example, the maximum tilting angle) is calculated for the hydraulic pump 22 in accordance with the high fan target rotational speed concerned, the target control current to achieve the target tilting angle concerned is calculates in the control current calculator 35*h*, and the control current corresponding to the target control current is output to the solenoid 25*a* of the solenoid control valve 25. Accordingly, in the regulator 24, the tilting angle of the hydraulic pump 22 (accordingly, the delivery capacity of the hydraulic pump 22) is controlled to increase, the delivery flow rate of the pump increases, and the rotational speed of the hydraulic motor 23 and the cooling fan 9 is controlled to be equal to the high fan target rotational speed calculated in the first fan target rotational speed calculator 35*a*. Accordingly, the air flow amount generated by the cooling fan 9 is increased, so that the radiator 6 is properly cooled by the air flow and thus the coolant passing through the radiator 6 is cooled.

In the case where the temperature of the hydraulic operating fluid of the hydraulic system (hydraulic operating fluid temperature) used in the hydraulic pump 3, etc. under stationary operation increases, the same operation is carried out when the temperature of the torque-converter hydraulic operating fluid used in the torque converter 2 (torque-converter oil temperature) increases, and these hydraulic operating fluids are likewise cooled.

<Under Non-Operation>

Under non-operation in which the wheel loader neither travels nor works, the acceleration pedal 12 is not depressed, and thus the engine 1 is kept under a low-speed idling state. In the fourth fan target rotational speed calculator 35*e* of the controller 35, a low fan target rotational speed (for example, the lowest fan target rotational speed) is calculated in accordance with the low-speed engine rotational speed, and the low fan target rotational speed calculated in the fourth fan target rotational speed calculator 35*e* is selected in the minimum value selector 35*f*. As a result, in the pump tilting angle calculator 35*g*, a small target tilting angle (for example, the minimum tilting angle) is calculated for the hydraulic pump 22 in accordance with the low fan target rotational speed concerned, and the tilting angle of the hydraulic pump 22 (thus the delivery capacity of the hydraulic pump 22) is controlled to decrease. The delivery flow rate of the hydraulic pump 22 is set to a small value, and the hydraulic motor 23 and the cooling fan 9 are rotated at a relatively low speed. In this case, even if the temperature of any one of the coolant, the hydraulic operating fluid of the hydraulic system and the torque-converter hydraulic operating fluid is high, the operation state is set to the non-operation state at this time and thus the temperature does not further increase. Therefore, no problem occurs by leaving the system to natural cooling.

<Under Travel Acceleration>

Travel acceleration in which the acceleration pedal 12 is depressed from the non-operation state to increase the rotational speed of the engine will be described.

The prior art is not provided with means corresponding to the fourth fan target rotational speed calculator 35*e* and the minimum value selector 35*f* shown in FIG. 3 according to this embodiment. Therefore, under non-operation, when the temperature of any one of the coolant, the hydraulic operating fluid of the hydraulic system and the torque-converter hydraulic operating fluid is high, the fan target rotational speed is set to a high value, and the tilting angle of the hydraulic pump 22 (accordingly, the delivery capacity of the hydraulic pump 22) is controlled to increase, thereby increasing the delivery flow rate of the hydraulic pump 22, so that the cooling fan 9 is rotated at high speed. When the acceleration pedal 12 is depressed from the above state to increase the engine rotational speed, the driving pressure of the hydraulic motor 23 for rotating the cooling fan 9 (the delivery pressure of the hydraulic pump 22 increases greatly simultaneously with the increase of the rotational speed of the engine because the hydraulic pump 22 has a large capacity and the delivery flow rate of the pump is large, so that the engine load at the time of increasing the engine rotation increases greatly, and thus the spewing of the engine 1 (the rotation increasing speed of the engine) worsens. This causes reduction in travel acceleration performance and reduction in working machine speed. Furthermore, the exhaust gas quality worsens, and an environment pollution problem is caused.

As compared with the prior art as described above, this embodiment is provided with the fourth fan target rotational speed calculator 35*e* and the minimum value selector 35*f* shown in FIG. 3, and thus under non-operation, the fan target rotational speed is set to a low rotational speed (for example, the lowest rotational speed) irrespective of the temperature, the tilting angle of the hydraulic pump 22 (accordingly, the delivery capacity of the hydraulic pump 22) is set to a small value (for example, the minimum value) and the delivery flow rate of the hydraulic pump 22 is set to a small value as described above. Therefore, when the acceleration pedal 12 is depressed to increase the engine rotational speed under travel acceleration, the increase of the drive pressure of the hydraulic motor 23 (the delivery pressure of the hydraulic pump 22) due to increase of the rotation of the cooling fan 9 is suppressed until the rotational speed of the engine increases to some extent, and thus the load on the engine 1 can be reduced. Accordingly, the engine rotational speed increases smoothly, and the working efficiency can be enhanced. Furthermore, since the rotational speed of the engine increases smoothly, the deterioration of the exhaust gas is little, and there is no risk that the environment is polluted.

As described above, according to this embodiment, the rotational speed of the cooling fan is controlled to the optimum rotational speed in accordance with the temperature increase of the coolant, and the engine rotational speed can be smoothly increased when the engine rotational speed under travel acceleration is increased. As a result, the working efficiency is enhanced, and the deterioration of the exhaust gas is little, so that there is no risk that the environment is polluted.

Figure 4:
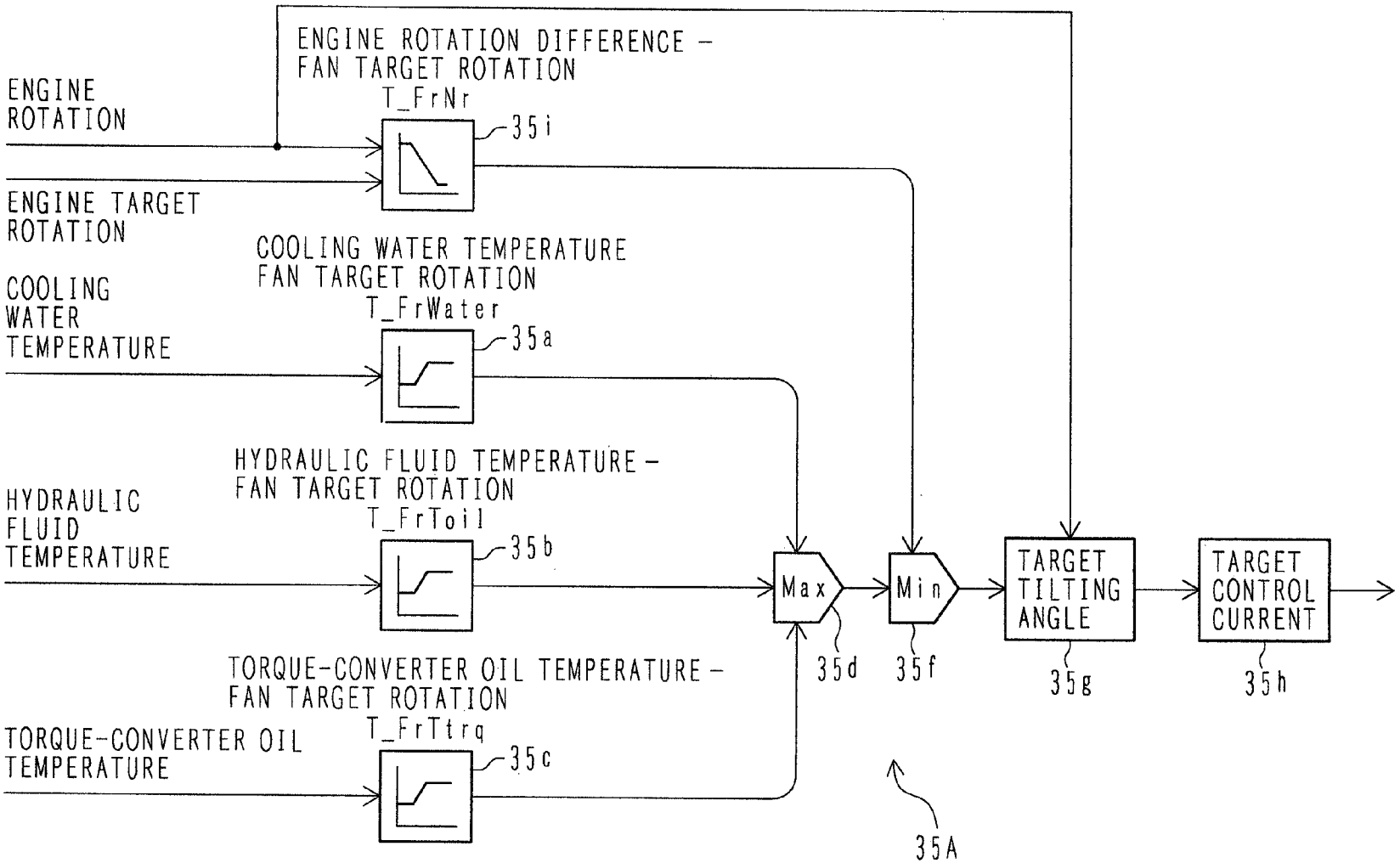
FIG. 4 is a functional block diagram showing the processing function of the controller in the cooling fan drive system for a travel type working machine according to a second embodiment of the invention.

A second embodiment of the invention will be described with reference to FIG. 4. In FIG. 4, the same elements as shown in FIG. 3 are represented by the same reference numerals. In the first embodiment, the limiting value of the fan target rotational speed is calculated from the engine rotational speed (the actual rotational speed of the engine. However, in this embodiment, the limiting value of the fan target rotational speed is calculated from the difference between the engine target rotational speed and the engine rotational speed (engine actual rotational speed).

In FIG. 4, a controller 35A having a cooling fan drive system according to this embodiment has the respective functions of the first fan target rotational speed calculator 35*a*, the second fan target rotational speed calculator 35*b*, the third fan target rotational speed calculator 35*c*, the maximum value selector 35*d*, the fourth fan target rotational speed calculator 35*i*, the minimum value selector 35*f*, the pump tilting angle calculator 35*g* and the control current calculator 35*h*.

The functions of the other processors other than the fourth target rotational speed calculator 35*i* are substantially the same as the first embodiment shown in FIG. 3.

The fourth fan target rotational speed calculator 35*i* receives the engine rotational speed (engine actual rotational speed) detected by the rotational speed sensor 34 and the instruction signal of the acceleration pedal 12 (the engine target rotational speed), calculates the rotational speed deviation ΔN corresponding to the difference between the engine target rotational speed and the engine rotational speed (actual rotational speed), and refers to a table stored in a memory with respect to the rotational speed deviation ΔN, thereby calculating the fan target rotational speed corresponding to the rotational deviation ΔN at that time. In the table of this memory is set the relationship between the rotational speed deviation ΔN and the fan target rotational speed in which the fan target rotational speed decreases as the rotational speed deviation ΔN increases.

In the minimum value selector 35*f*, the fan target rotational speed calculated in the fourth fan target rotational speed calculator 35*i* is set as the limiting value, and the fan target rotational speed is corrected so that the fan target rotational speed selected in the maximum value selector 35*d* does not exceed the limiting value concerned.

In this case, the regulator 24 of the hydraulic pump 22 (see FIG. 1) and the respective functions of the first fan target rotational speed calculator 35*a*, the second fan target rotational speed calculator 35*b*, the third fan target rotational speed calculator 35*c*, the maximum value selector 35*d*, the fourth fan target rotational speed calculator 35*i*, the minimum value selector 35*f*, the pump tilting angle calculator 35*g* and the control current calculator 35*h* of the controller 35A constitute the cooling fan control means for controlling the rotational speed of the hydraulic motor 23 on the basis of the detection values of the temperature sensors 31 to 33 (temperature detecting means) and the rotational speed sensor 34 (rotational speed detecting means) so that the rotational speed of the cooling fan 9 increases as the temperature of the coolant increases and also the increase of the rotational speed of the cooling fan 9 is limited when the rotational speed of the engine increases due to increase of the target rotational speed of the engine 1.

Furthermore, the cooling fan control means calculates the fan target rotational speed that increases as the temperature of the coolant increases, calculates the limiting value of the fan target rotational speed that decreases as the rotational speed deviation between the target rotational speed and the actual rotational speed of the engine 1 increases, and corrects the fan target rotational speed so that the fan target rotational speed does not exceed the limiting value concerned, whereby the rotational speed of the hydraulic motor 23 is controlled so as to achieve the corrected fan target rotational speed.

In this embodiment thus constructed, under stationary operation, the rotational speed of the engine 1 (the engine actual rotational speed) is controlled to a value near to the target rotational speed of the engine by the well-known engine control function of the controller 35, and thus the rotational speed deviation ΔN is relatively small. In the fourth target rotational speed calculator 35*i*, a high fan target rotational speed (for example, the maximum fan target rotational speed) is calculated in accordance with the rotational speed deviation ΔN concerned, and in the minimum value selector 35*f*, the fan target rotational speed selected in the maximum value selector 35*d* is selected. Therefore, when the temperature of any one of the coolant, the hydraulic operating fluid of the hydraulic system and the torque-converter hydraulic operating fluid increases under stationary operation, a high fan target rotational speed is set and the hydraulic motor 23 and the cooling fan 9 are rotated at high speed to suppress the increase of the temperature as in the case of the first embodiment.

Under the state that the wheel loader is not operated, the acceleration pedal 12 is not depressed. Therefore, the rotational speed of the engine 1 (the engine actual rotational speed) is controlled to be near to the engine target rotational speed (idling rotational speed) of the engine. Therefore, as in the case of the stationary operation, the rotational speed deviation ΔN is relatively small, a high fan target rotational speed (for example, the highest fan target rotational speed) is calculated in accordance with the rotational speed deviation ΔN in the fourth fan target rotational speed calculator 35*i*, and the fan target rotational speed selected in the maximum value selector 35*d* is selected in the minimum value selector 35*f*. Therefore, when the temperature of any one of the coolant, the hydraulic operating fluid of the hydraulic system and the torque-converter hydraulic operating fluid is high, a high fan target rotational speed is set in accordance with the high temperature concerned, and the hydraulic motor 23 and the cooling fan 9 are rotated at high speed, so that the coolant, etc. are properly cooled.

Under the travel acceleration in which the acceleration pedal 12 is depressed from the non-operation state as described above to increase the engine rotational speed, the rotational speed deviation ΔN corresponding to the difference between the engine target rotational speed and the engine actual rotational speed increases, a low fan target rotational speed (for example, the lowest fan target rotational speed) is calculated in accordance with the rotational speed deviation ΔN in the fourth fan target rotational speed calculator 35*i*, and the fan target rotational speed concerned is selected in the minimum value selector 35*f*. As a result, the tilting angle of the hydraulic pump 22 (accordingly, the delivery capacity of the hydraulic pump 22) is controlled to decrease, and the increase of the drive pressure of the hydraulic motor 23 (the delivery pressure of the hydraulic pump 22) due to the increase of the rotation of the cooling fan 9 is suppressed, whereby the load on the engine 1 can be reduced. Accordingly, the engine rotational speed can be smoothly increased, and the working efficiency can be enhanced. Furthermore, since the engine rotational speed smoothly increases, and thus the deterioration of the exhaust gas is little and there is no risk that the environment is polluted.

As described above, this embodiment can also achieve the same effect as the first embodiment.

Furthermore, according to this embodiment, since the limiting value of the fan target rotational speed is calculated from the difference between the engine target rotational speed and the engine actual rotational speed, a high fan target rotational speed is set and the cooling fan 9 is rotated at high speed even when the temperature of any one of the coolant, the hydraulic fluid of the hydraulic system and the torque-converter hydraulic operating fluid is high, so that the coolant, etc. can be cooled.

Figure 5:
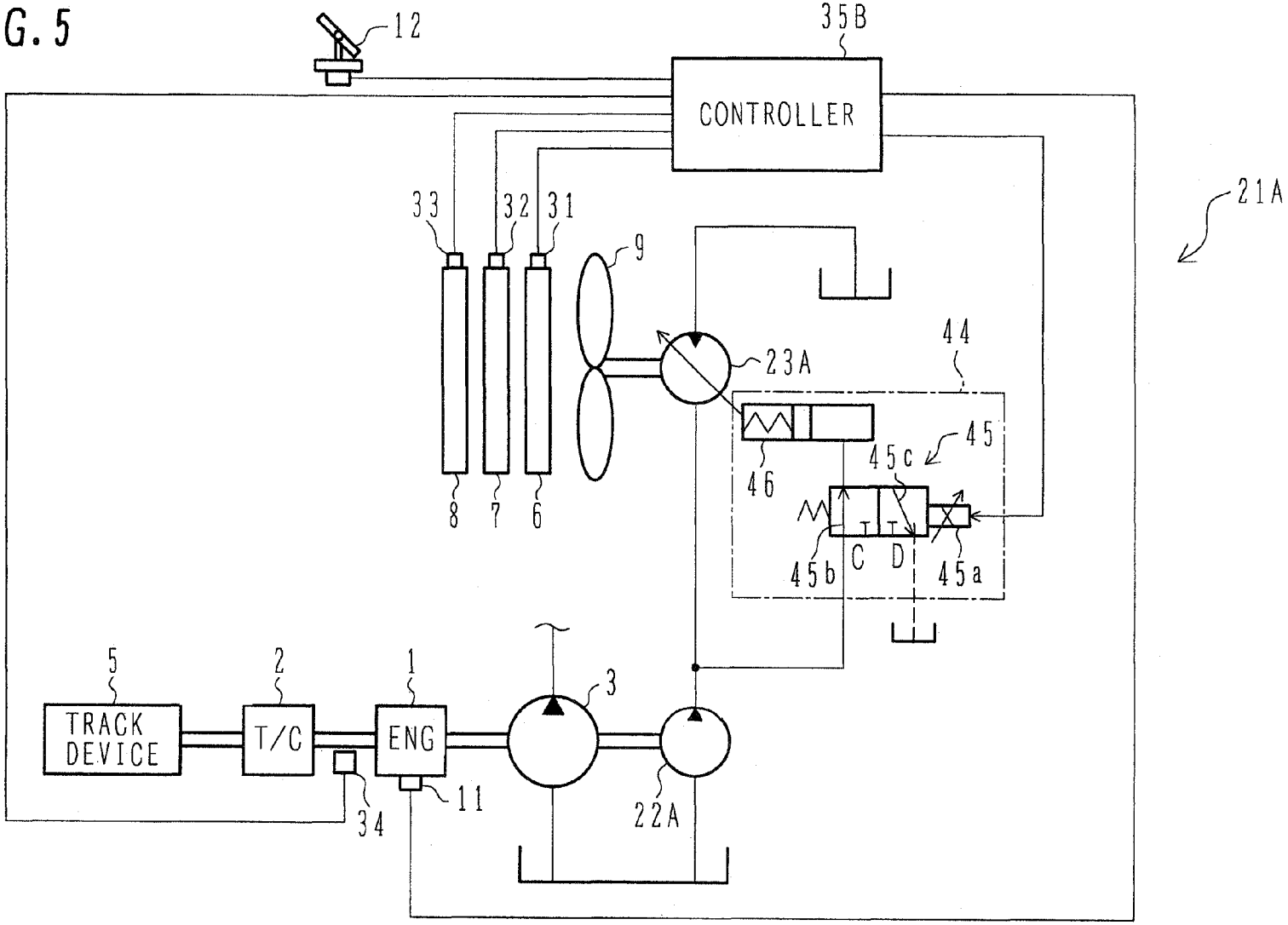
FIG. 5 is a diagram showing a cooling fan drive unit for a travel type working machine according to a third embodiment of the invention together with the surrounding construction thereof.

A third embodiment of the invention will be described with reference to FIGS. 5 and 6. In FIG. 5, the same elements as shown in FIG. 1 are represented by the same reference numerals, and in FIG. 6 the same elements as shown in FIG. 3 are represented by the same reference numerals. In the first and second embodiments, the rotational speed of the hydraulic motor (cooling fan) is controlled by controlling the delivery capacity of the hydraulic pump. However, according to this embodiment, the rotational speed of the hydraulic motor (cooling fan) is controlled by controlling the delivery capacity of the hydraulic motor linked to the cooling fan.

In FIG. 5, a cooling fan drive system 21A of this embodiment has a hydraulic pump 22A driven by the engine 1, and a hydraulic motor 23A that is actuated by a hydraulic fluid delivered by the hydraulic pump 22A to rotate the cooling fan 9. The hydraulic pump 22A is a fixed displacement type hydraulic pump, and the hydraulic motor 23A is a variable displacement type hydraulic motor. The displacement volume (capacity) of the hydraulic motor 23A is controlled by varying the tilting angle of the swash plate of the hydraulic motor 23A (hereinafter referred to as tilting angle or tilting) through a regulator 44. The regulator 44 has a solenoid control valve 45 and a tilting actuator 46.

The solenoid control valve 45 is located at a first position C shown in FIG. 5 when the control current supplied form a solenoid 45*a* is equal to zero, is stroked from the first position C to a second position D as the control current increases, and switched to the second position D when the control current is at a maximum. When the solenoid control valve 45 is located at the first position C at the left side of FIG. 5, the opening area of a first hydraulic line 45*b* for connecting the hydraulic motor 23A and the tilting actuator 46 is set to the maximum value, a second hydraulic line 45*c* for connecting the tilting actuator 46 and the tank is closed, and the drive pressure of the tilting actuator 46 is set to the maximum pressure (the delivery pressure of the hydraulic pump 22A). Accordingly, the tilting actuator 46 controls the tilting angle of the hydraulic motor 23A so that the displacement volume (capacity) of the hydraulic motor 23A is at a maximum, and controls the rotational speed of the hydraulic motor 23A so that the rotational speed of the hydraulic motor 23A is at a minimum. When the solenoid control valve 45 is switched to the second position D at the right side of FIG. 5, the first hydraulic line 45*b* is closed, the opening area of the second hydraulic line 45*c* is set to the maximum value and the drive pressure of the tilting actuator 46 is set to the lowest pressure (tank pressure). Accordingly, the tilting actuator 46 controls the tilting angle of the hydraulic motor 23A so that the displacement volume (capacity) of the hydraulic motor 23A, and controls the rotational speed of the hydraulic motor 23A so that the rotational speed of the hydraulic motor 23A is at a maximum. As the solenoid control valve 45 is stroked from the first position C at the left side of FIG. 5 to the second position D at the right side of FIG. 5, the opening area of the first hydraulic line 45*b* is reduced, the opening area of the second hydraulic line 45*c* is increased, and the drive pressure of the tilting actuator 46 is set to the pressure corresponding to the stroke position of the solenoid control valve 45 (the magnitude of the control current supplied to the solenoid 45*a*). Accordingly, the tilting actuator 46 controls the tilting angle of the hydraulic motor 23A so that the displacement volume (capacity) of the hydraulic motor 23A increases in accordance with the stroke position of the solenoid control valve 45 (the magnitude of the control current supplied to the solenoid 45*a*), and the rotational speed of the hydraulic motor 23A is controlled in accordance with the controlled tilting angle.

Figure 6:
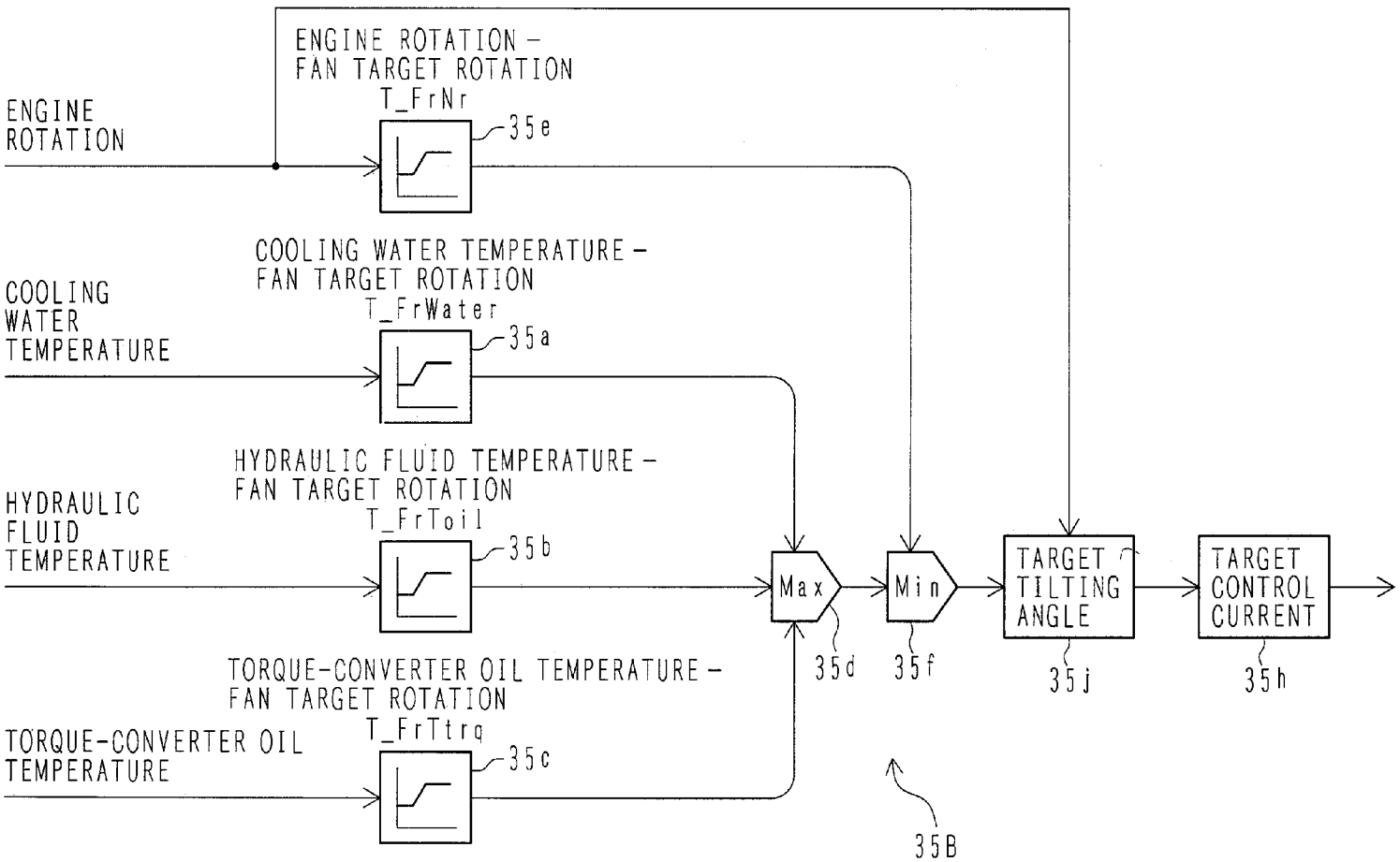
FIG. 6 is a functional block diagram showing the processing function of the controller in the cooling fan drive system for the travel type working machine according to the third embodiment of the invention.

In FIG. 6, a controller 35B has the respective functions of the first fan target controller 35*a*, the second fan target rotational speed calculator 35*b*, the third fan target rotational speed calculator 35*c*, the maximum selector 35*d*, the fourth fan target rotational calculator 35*e*, the minimum value selector 35*f*, the motor tilting angle calculator 35*j* and the control current calculator 35*h*.

The functions of the processors other than the motor tilting angle calculator 35*j* are substantially the same as the first embodiment shown in FIG. 3.

On the basis of the rotational speed of the engine 1 detected by the rotational speed sensor 34 and the fan target rotational speed selected in the minimum value selector 35*f*, the motor tilting angle calculator 35*j* calculates the target tilting angle of the hydraulic motor 23A to achieve the fan target rotational speed concerned.

Here, the rotational speed of the fan 9 is equal to the rotational speed of the hydraulic motor 23A, and the rotational speed of the hydraulic motor 23A is determined by the flow rate of the hydraulic fluid flowing in the hydraulic motor 23A and the tilting angle of the hydraulic motor 23A. The flow rate of the hydraulic fluid flowing in the hydraulic motor 23A is equal to the delivery flow rate of the hydraulic pump 22A, and the delivery flow rate of the hydraulic pump 22A is determined by the displacement volume (capacity) and rotational speed of the hydraulic pump 22. The hydraulic pump 22A is a fixed displacement type, and the displacement volume (capacity) thereof is well known. Therefore, the rotational speed of the hydraulic pump 22A is determined by the rotational speed of the engine 1. Accordingly, if the rotational speed of the engine 1 is known, the target tilting angle of the hydraulic motor 23A to achieve the fan target rotational speed could be calculated.

The control current calculator 35*h* calculates the target control current of the solenoid 45*a* of the solenoid control valve 45 to achieve the target tilting angle calculated in the motor tilting angle calculator 35*j*.

The controller 35B generates the control current corresponding to the target control current thus determined, and outputs the control current concerned to the solenoid 45*a* of the solenoid control valve 45.

The regulator 44 of the hydraulic motor 23A and the respective functions of the first fan target rotational speed calculator 35*a*, the second target rotational calculator 35*b*, the third fan target rotational speed calculator 35*c*, the maximum value selector 35*d*, the fourth fan target rotational speed calculator 35*e*, the minimum value selector 35*f*, the motor tilting angle calculator 35*j* and the control current calculator 35*h* of the controller 35B constitute the cooling fan control means for controlling the rotational speed of the hydraulic motor 23A on the basis of the detection values of the temperature sensors 31 to 33 (temperature detecting means) and the rotational speed sensor 34 (rotational speed detecting means) so that the rotational speed of the cooling fan 9 is increased according to the temperature of the coolant increase and also the increase of the rotational speed of the cooling fan 9 is limited when the rotational speed of the engine is increased due to the increase of the target rotational speed of the engine 1.

Furthermore, the cooling fan control means calculates the fan target rotational speed that increases as the temperature of the coolant increases, calculates the limiting value of the fan target rotational speed that decreases as the rotational speed of the engine is reduced, corrects the fan target rotational speed so that the fan target rotational speed does not exceed the limiting value, and controls the rotational speed of the hydraulic motor 23A so as to achieve the corrected fan target rotational speed.

In this embodiment thus constructed, under stationary operation, the engine 1 is rotated at high speed. Accordingly, a high fan target rotational speed (for example, the highest target rotational speed) is calculated in accordance with the engine rotational speed concerned in the fourth fan target rotational speed calculator 35*e*, and the fan target rotational speed selected in the maximum value selector 35*d* is selected in the minimum value selector 35*f*. Therefore, when the temperature of any one of the coolant, the hydraulic operating fluid of the hydraulic system and the torque-converter hydraulic operating fluid increases, a high fan target rotational speed is set as in the case of the first embodiment, a small target tilting angle is calculated for the hydraulic motor 23A in accordance with the high fan target rotational speed concerned in the pump tilting angle calculator 35*j*, the target control current to achieve the target tilting angle is calculated in the control current calculator 35*h*, and the control current corresponding to the target control current is output to the solenoid 45*a* of the solenoid control valve 45. Accordingly, in the regulator 44, the tilting angle of the hydraulic motor 23A (thus the delivery capacity of the hydraulic motor 23A) is controlled to be reduced, and the rotational speed of the hydraulic motor 23A and the cooling fan 9 are controlled to be equal to the fan target rotational speed calculated in the first fan target rotational speed calculator 35*a*. Accordingly, the flow rate generated by the cooling fan 9 is increased, the radiator 6 is properly cooled by the air flow and the coolant passing through the radiator 6 is cooled.

Since the acceleration pedal 12 is not depressed under non-operation of the wheel loader, a low fan target rotational speed (for example, the lowest fan target rotational speed) is calculated in accordance with the low-speed engine rotational speed in the fourth fan target rotational speed calculator 35*e*, and the fan target rotational speed calculated in the fourth fan target rotational speed calculator 35*e* is selected in the minimum value selector 35*f*. As a result, a large target tilting angle is calculated for the hydraulic motor 23A in accordance with the low fan target rotational speed in the pump tilting angle calculator 35*j*, the tilting angle of the hydraulic motor 23A (accordingly, the delivery capacity of the hydraulic motor 23A) is controlled to increase and the hydraulic motor 23A and the cooling fan 9 are rotated at low speed.

Under the travel acceleration state in which the acceleration pedal 12 is depressed from the non-operation state as described above to increase the engine rotational speed, the engine target rotational speed is increased by depressing the acceleration pedal 12. However, under the non-operation just before the acceleration pedal is depressed, the fan target rotational speed is set to a low rotational speed irrespective of the temperature as described above, and the tilting angle of the hydraulic motor 23A (thus, the delivery capacity of the hydraulic motor 23A) is controlled to increase, so that the rotational speeds of the hydraulic motor 23A and the cooling fan 9 are set to low values. Therefore, when the acceleration pedal 12 is depressed to increase the engine rotational speed, the increase of the drive pressure of the hydraulic motor 23 (the delivery pressure of the hydraulic pump 22) due to the increase of the rotational of the cooling fan 9 is suppressed, and thus the load on the engine 1 can be reduced. Accordingly, the engine rotational speed increases smoothly, and the working efficiency can be enhanced. Furthermore, since the engine rotational speed increases smoothly, the deterioration of the exhaust gas is little and there is no risk in environmental pollution.

As described above, the same effect as the first embodiment can be achieved by this embodiment.

Figure 7:
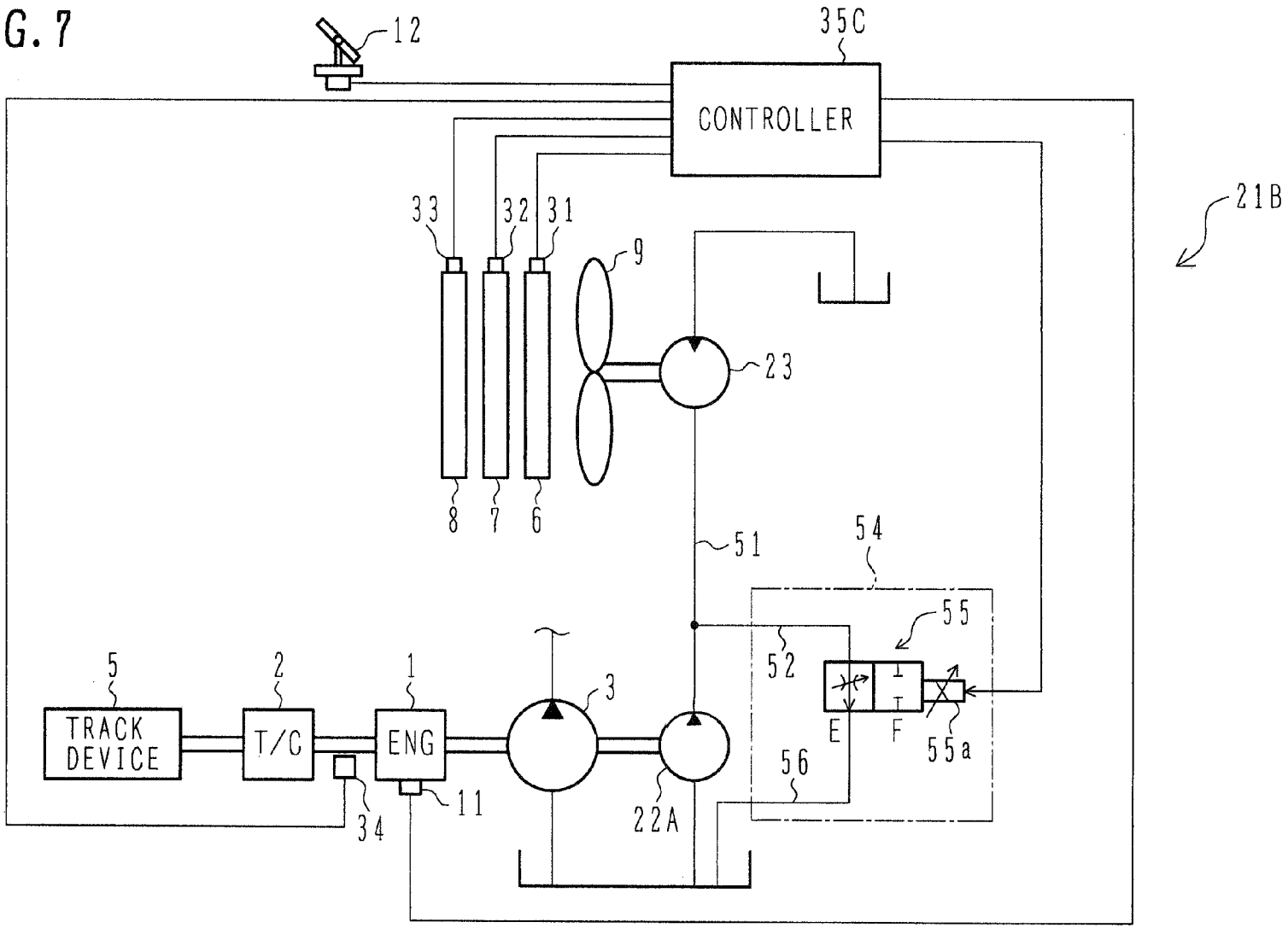
FIG. 7 is a diagram showing a cooling fan drive system for a travel type working machine according to a fourth embodiment of the invention together with the surrounding construction thereof.

A fourth embodiment of the invention will be described with reference to FIGS. 7 and 8. In FIG. 7, the same elements as shown in FIGS. 1 and 5 are represented by the same reference numerals, and in FIG. 8, the same elements as shown in FIG. 3 are represented by the same reference numerals. In the first to third embodiments, the rotational speed of the hydraulic motor (cooling fan) is controlled by controlling the delivery capacity of the hydraulic pump or the hydraulic motor. However, in this embodiment, the rotational speed of the hydraulic motor (cooling fan) is controlled by controlling a bypass flow rate flowing in a bypass circuit to the hydraulic fluid supply line of the hydraulic pump.

In FIG. 7, the cooling fan drive device 21B of this embodiment has a hydraulic pump 22A to be driven by the engine 1, and a hydraulic motor 23 that is actuated by the hydraulic fluid delivered by the hydraulic pup 22A to rotate the cooling fan 9. The hydraulic pump 22A is a fixed displacement type hydraulic pump, and the hydraulic motor 23 is also a fixed displacement type hydraulic motor. The hydraulic fluid supply line 51 for intercommunicating the hydraulic pump 22A and the hydraulic motor 23 is provided with a bypass circuit 54 for connecting the hydraulic fluid supply line 51 to the tank. This bypass circuit 54 has a bypass hydraulic line 52 branched from the hydraulic fluid supply line 51, a solenoid control valve 55 provided to the bypass hydraulic line 52 and a tank hydraulic line 56 for connecting the solenoid control valve 55 to the tank.

The solenoid control valve 55 is set to a first position E shown in FIG. 7 when the control current supplied to the solenoid 55*a* is equal to zero, stroked from the first position E to a second position F when the control current increases, and switched to the second position F when the control current is at a maximum. When the solenoid control valve 45 is located at the first position E at the left side of FIG. 7, the opening area of the hydraulic line b for connecting the bypass hydraulic line 52 and the tank hydraulic line 56 is maximized, and the bypass flow rate returning from the bypass hydraulic line 52 to the tank is maximized. Accordingly, the flow rate of the hydraulic fluid supplied from the hydraulic pump 22A to the hydraulic motor 23 is at a minimum, and the rotational speed of the hydraulic motor 23 is at a minimum. When the solenoid control valve 5 is switched to the second position F at the right side of FIG. 7, the hydraulic line 55*b* is closed, and the bypass flow rate returning from the bypass hydraulic line 52 to the tank is set to zero. Accordingly, the total delivery flow rate of the hydraulic pump 22A is supplied to the hydraulic motor 23, and the flow rate of the hydraulic fluid supplied from the hydraulic pump 22A to the hydraulic motor 23 is at a maximum, and the rotational speed of the hydraulic pump 23 is also at a maximum. The opening area of the hydraulic line 55*b* is reduced as the solenoid control valve 55 strokes from the first position E at the left side of FIG. 7 to the second position F at the right side of FIG. 7, and the bypass flow rate returning from the bypass hydraulic line 52 to the tank is reduced in accordance with the opening area concerned. Accordingly, the flow rate of the hydraulic fluid supplied form the hydraulic pump 22A to the hydraulic motor 23 is controlled to increase in accordance with the stroke position of the solenoid control valve 55 (the magnitude of the control current supplied to the solenoid 55*a*), and the rotational speed of the hydraulic motor 23 is also controlled in accordance with the stroke position.

Figure 8:
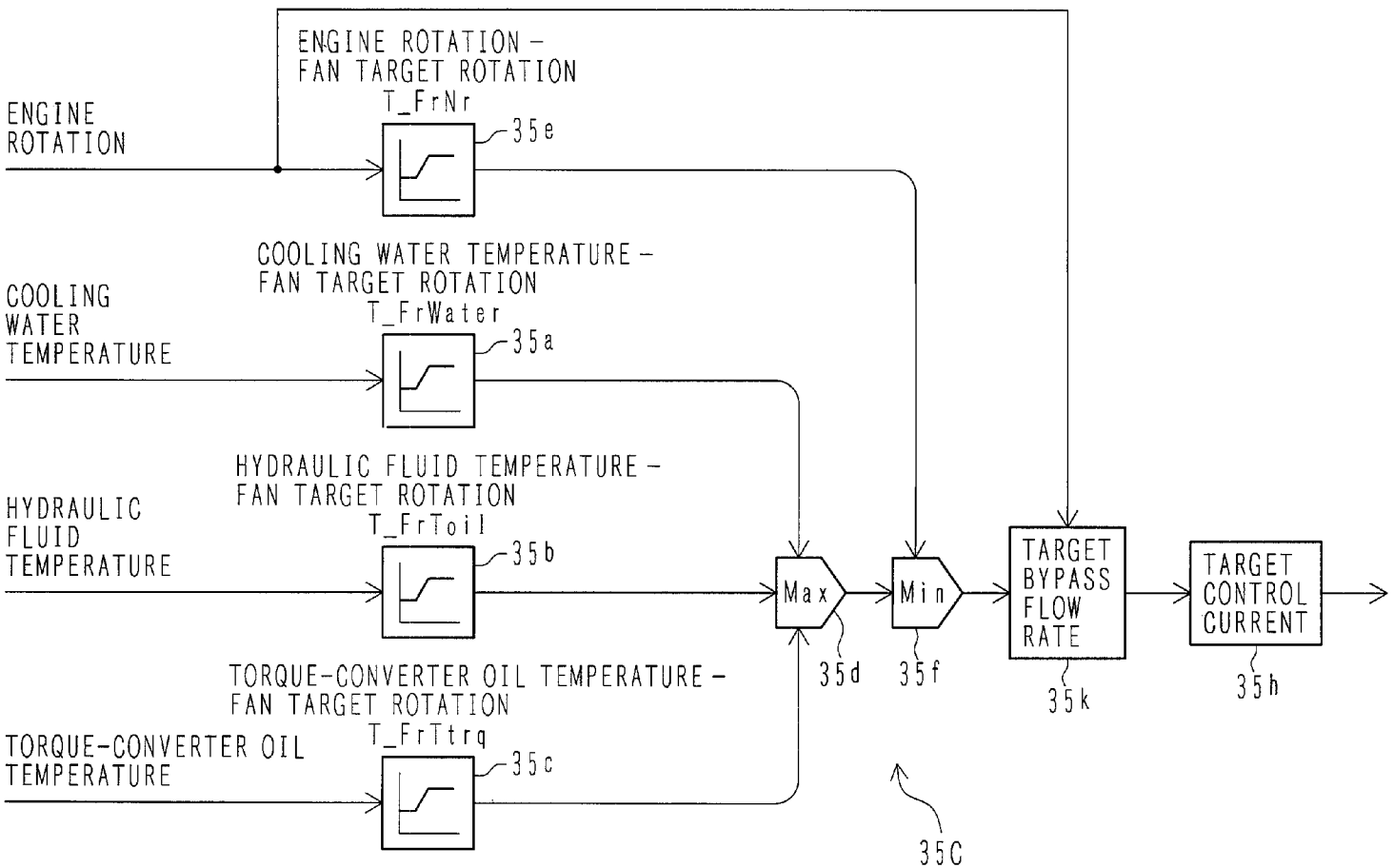
FIG. 8 is a functional block diagram showing the processing function of the controller in the cooling fan drive system for the travel type working machine according to the fourth embodiment of the invention.

In FIG. 8, the controller 35C has the respective functions of the first fan target rotational speed calculator 35*a*, the second fan target rotational speed calculator 35*b*, the third fan target rotational speed calculator 35*c*, the maximum value selector 35*d*, the fourth fan target rotational speed calculator 35*e*, the minimum value selector 35*f*, the bypass flow rate calculator 35*k* and the control current calculator 35*b*.

The functions of the processors other than the bypass flow rate calculator 35*k* are substantially the same as the first embodiment shown in FIG. 3.

On the basis of the rotational speed of the engine 1 detected by the rotational speed sensor 34 and the fan target rotational speed selected in the minimum value selector 35*f*, the bypass flow rate calculator 35*k* calculates the target bypass flow rate to achieve the fan target rotational speed concerned.

Here, the rotational speed of the fan 9 is equal to the rotational speed of the hydraulic motor 23, and the rotational speed of the hydraulic motor 23 is determined by the flow rate of the hydraulic fluid flowing in the hydraulic motor 23. The flow rate of the hydraulic fluid flowing through the hydraulic motor 23 is equal to the flow rate achieved by subtracting from the bypass flow rate of the hydraulic pump 22 the bypass flow rate which is returned through the bypass hydraulic line 52 and the solenoid control valve 55 to the tank, and the delivery flow rate of the hydraulic pump 22 is determined by the displacement volume (capacity) and the rotational speed of the hydraulic pump 22. The hydraulic pump 22A is a fixed displacement type and thus the displacement volume (capacity) thereof is known. Therefore, the rotational speed of the hydraulic pump 22A is determined by the rotational speed of the engine 1. Accordingly, if the rotational speed of the engine 1 is known, the bypass flow rate to achieve the fan target rotational speed could be calculated.

The control current calculator 35*h* calculates the target control current of the solenoid 55*a* of the solenoid control valve 55 to achieve the target bypass flow rate calculated in the bypass flow rate calculator 35*k*.

The controller 35C generates the control current corresponding to the target control current thus determined, and outputs the control current to the solenoid 55*a* of the solenoid control valve 55.

The bypass circuit 54 and the respective functions of the first fan target rotational speed calculator 35*a*, the second fan target rotational speed calculator 35*b*, the third fan target rotational speed calculator 35*c*, the maximum value selector 35*d*, the fourth fan target rotational speed calculator 35*e*, the minimum value selector 35*f*, the bypass flow rate calculator 35*k* and the control current calculator 35*h* of the controller 35C constitutes the cooling fan control means for controlling the rotational speed of the hydraulic motor 23 on the basis of the detection values of the temperature sensors 31 to 33 (temperature detecting means) and the rotational speed sensor 34 (rotational speed detecting means) so that the rotational speed of the cooling fan 9 is increased as the temperature of the coolant increases, and the increase of the rotational speed of the cooling fan 9 is limited when the rotational speed of the engine increases due to the increase of the target rotational speed of the engine 1.

In the embodiment thus constructed, since the engine 1 is rotated at high speed under stationary operation, a high fan target rotational speed (for example, the highest fan target rotational speed) is calculated in accordance with the engine rotational speed in the fourth fan target rotational speed calculator 35*e*, and the fan target rotational speed selected in the maximum value selector 35*d* is selected in the minimum value selector 35*f*. Therefore, when the temperature of any one of the coolant, the hydraulic operating fluid of the hydraulic system and the torque-converter hydraulic operating fluid increases under stationary operation, as in the case of the first embodiment, a high fan target rotational speed is set, a small target bypass flow rate is calculated in accordance with the high fan target rotational speed concerned in the bypass flow rate calculator 35*k*, target control current to achieve the target bypass flow rate concerned is calculated in the control current calculator 35*h*, and the control current corresponding to the target control current concerned is output to the solenoid 55*a* of the solenoid control valve 55. Accordingly, the solenoid control valve 55 is controlled so that the bypass flow rate is reduced, the supply flow rate to the hydraulic motor 23 is increased, and the rotational speed of the hydraulic motor 23 and the cooling fan 9 is controlled to be equal to the high fan target rotational speed calculated in the first fan target rotational speed calculator 35*a*. Accordingly, the air flow amount generated by the cooling fan 9 is increased, the radiator 6 is properly cooled by the air flow, and the coolant passing through the radiator 6 is cooled.

Under non-operation of the wheel loader, the acceleration pedal 12 is not depressed. Therefore, a low fan target rotational speed (for example, the lowest fan target rotational speed) is calculated in accordance with the low-speed engine rotational speed in the fourth fan target rotational speed calculator 35*e*, and the fan target rotational speed calculated in the fourth fan target rotational speed calculator 35*e* is selected in the minimum value selector 35*f*. As a result, a large target bypass flow rate is calculated in accordance with the low fan target rotational speed in the bypass flow rate calculator 35*k*, and the bypass flow amount flowing in the bypass circuit 54 is controlled to be large, so that the hydraulic motor 23A and the cooling fan 9 are rotated at a low speed.

Under the travel acceleration in which the acceleration pedal 12 is depressed from the non-operation state as described above to increase the engine rotational speed, the engine target rotational speed is increased by depressing the acceleration pedal 12. However, under the non-operation state just before the acceleration pedal is depressed, the fan target rotational speed is set to a low rotational speed irrespective of the temperature as described above, the bypass flow rate is controlled to be large, and the rotational speeds of the hydraulic motor 23 and the cooling fan are set to small values. Therefore, when the acceleration pedal 12 is depressed to increase the engine rotational speed, the increase of the drive pressure of the hydraulic motor 23 (the delivery pressure of the hydraulic pump 22) due to the increase of the rotation of the cooling fan 9 is suppressed, and thus the load on the engine 1 can be reduced. Accordingly, the engine rotational speed can increase smoothly, and thus the working efficiency can be enhanced. Furthermore, since the engine rotational speed increases smoothly, there is little deterioration of the exhaust gas, and there is no risk of environmental pollution.

The same effect as the first embodiment can be achieved by the embodiment as described above.

Various modifications may be made on the above-described embodiment within the spiritual scope of the invention. For example, in the above embodiment, the wheel loader is described as the travel type working machine. However, the invention may be applied to other travel type hydraulic working machines insofar as each machine is equipped with a cooling fan drive device. A telescopic handler, a crawler type or wheel type hydraulic shovel, etc. may be used as the other travel type hydraulic working machines to which the invention is applied.

Furthermore, in the above embodiment, the invention is applied to the travel type working machine having the three heat exchangers of the radiator 6 for cooling the engine cooling water, the oil cooler 7 for cooling the hydraulic operating fluid of the hydraulic system and the oil cooler 8 for cooling the torque-converter hydraulic operating fluid. However, even when a travel type working machine does not have the oil cooler 7 for cooling the hydraulic operating fluid of the hydraulic system or the oil cooler 8 for cooling the torque-converter hydraulic operating fluid, the invention may be applied to such a travel type working machine.

Furthermore, in the third embodiment shown in FIGS. 5 and 6 and the fourth embodiment shown in FIGS. 7 and 8, the fourth target rotational speed calculator for calculating the limiting value of the target fan rotational speed calculates the limiting value of the target fan rotational speed from the engine rotational speed as in the case of the first embodiment. However, the limiting value of the target fan rotational speed may be calculated from the rotational speed deviation $\Delta N$ corresponding to the difference between the engine target rotational speed and the engine actual rotational speed as in the case of the second embodiment shown in FIG. 4.

The invention claimed is:

1. A cooling fan drive system for a travel type working machine including an engine, an acceleration pedal for instructing a target engine rotational speed of said engine, a cooling fan for cooling an engine coolant, a hydraulic pump driven by said engine, and a hydraulic motor actuated by a hydraulic fluid delivered by the hydraulic pump for rotating the cooling fan, wherein said cooling fan drive system comprises:

engine speed control means for controlling a rotational speed of said engine such that the rotational speed of the engine decreases to a low-speed idling speed when said acceleration pedal is not operated and the rotational speed of the engine increases from said low-idling speed to a maximum rotational speed in accordance with an operation amount of the acceleration pedal when the acceleration pedal is operated;

temperature detecting means for detecting the temperature of the engine coolant;

rotational speed detecting means for detecting the rotational speed of the engine; and cooling fan control means for controlling the rotational speed of the hydraulic motor on the basis of the detection values of the temperature detecting means and the rotational speed detecting means so that the rotational speed of the cooling fan is increased as the temperature of the engine coolant increase and the increase of the rotational speed of the cooling fan is limited not to exceed a limiting value that increases as the rotational speed of the engine increases when the travel acceleration in which the rotational speed of the engine increases is performed by operating the acceleration pedal; and said cooling fan control means controls the rotational speed of the hydraulic motor such that the rotational speed of the cooling fan decreases to a lowest rotational speed regardless of the temperature of the engine coolant, when the acceleration pedal is not operated and the rotational speed of the engine decreases to said low-speed idling speed.

2. The cooling fan drive device for the travel type working machine according to claim 1, wherein the cooling fan control means calculates a fan target rotational speed that increases as the temperature of the engine coolant increases, calculates a limiting value of the fan target number that decreases as the rotational speed of the engine decreases, corrects the fan target rotational speed so that the fan target rotational speed does not exceed the limiting value, and controls the rotational speed of the hydraulic motor so as to achieve the corrected fan target rotational speed.

3. The cooling fan drive device for the travel type working machine according to claim 1, wherein the cooling fan control means calculates the fan target rotational speed that increases as the temperature of the engine coolant increases, calculates the limiting value of the fan target rotational speed that is lowered as the rotational speed difference between the target rotational speed and the actual rotational speed of the engine increases, corrects the fan target rotational speed so that the fan target rotational speed does not exceed the limiting value, and controls the rotational speed of the hydraulic motor so as to achieve the corrected fan target rotational speed.

4. The cooling fan drive device for the travel type working machine according to claim 1, wherein the hydraulic pump is a variable displacement hydraulic pump, and the cooling fan control means controls the rotational speed of the hydraulic motor by controlling the delivery capacity of the hydraulic pump.

5. The cooling fan drive device for the travel type working machine according to claim 1, wherein the hydraulic motor is a variable displacement hydraulic motor, and the cooling fan control means controls the rotational speed of the hydraulic motor by controlling the delivery capacity of the hydraulic motor.

6. The cooling fan drive device for the travel type working machine according to claim 1, further comprising a bypass circuit that is branched from a hydraulic fluid supplying line for supplying the hydraulic fluid delivered by the hydraulic pump to the hydraulic motor and connects the hydraulic fluid supplying line to a tank, wherein the cooling fan control means controls the rotational speed of the hydraulic motor by controlling a bypass flow rate flowing in the bypass circuit.

7. A cooling fan drive system for a travel type working machine having an engine, an acceleration pedal for instructing a target engine rotational speed of said engine and a hydraulic pump of a working hydraulic system driven by the engine, said cooling fan drive system including a cooling fan for cooling a coolant of the engine and a hydraulic fluid of the working hydraulic system, a hydraulic pump driven by the engine, and a hydraulic motor actuated by the hydraulic fluid delivered by the hydraulic pump for rotating the cooling fan, wherein said cooling fan drive system comprises:

engine speed control means for controlling a rotational speed of said engine such that the rotational speed of the engine decreases to a low-speed idling speed when said acceleration pedal is not operated and the rotational speed of the engine increases from said low-idling speed to a maximum rotational speed in accordance with an operation amount of the acceleration pedal when the acceleration pedal is operated;

first temperature detecting means for detecting the temperature of the engine coolant;

second temperature detecting means for detecting the temperature of the hydraulic fluid of the working hydraulic system;

rotational speed detecting means for detecting the rotational speed of the engine; and cooling fan control means for controlling the rotational speed of the hydraulic motor on the basis of the detection values of the first and second temperature detecting means and the rotational speed detecting means so that the rotational speed of the cooling fan is increased as any one of the temperature of the engine coolant and the hydraulic fluid of the working hydraulic system increases, and the increase of the rotational speed of the cooling fan is limited not to exceed a limiting value that increases as the rotational speed of the engine increases when the travel acceleration in which the rotational speed of the engine increases is performed by operating the acceleration pedal; and said cooling fan control means controls the rotational speed of the hydraulic motor such that the rotational speed of the cooling fan decreases to a lowest rotational speed regardless of the temperatures of the engine coolant and the hydraulic fluid of the working hydraulic system, when the acceleration pedal is not operated and the rotational speed of the engine decreases to said low-speed idling speed.

8. A cooling fan drive system for a travel type working machine having an engine, an acceleration pedal for instructing a target engine rotational speed of said engine, a hydraulic pump of a working hydraulic system driven by the engine and a travel device driven through a torque converter by the engine, said cooling fan drive system including a cooling fan for cooling a coolant of the engine, a hydraulic fluid of the working hydraulic system and an operating oil of the torque converter, a hydraulic pump driven by the engine and a hydraulic motor actuated by the hydraulic fluid delivered by the hydraulic pump for rotating the cooling fan, wherein said cooling fan drive system comprises:

engine speed control means for controlling a rotational speed of said engine such that the rotational speed of the engine decreases to a low-speed idling speed when said acceleration pedal is not operated and the rotational speed of the engine increases from said low-idling speed to a maximum rotational speed in accordance with an operation amount of the acceleration pedal when the acceleration pedal is operated;

first temperature detecting means for detecting the temperature of the engine coolant;

second temperature detecting means for detecting the temperature of the hydraulic fluid of the working hydraulic system;

third temperature detecting means for detecting the temperature of the operating oil of the torque converter;

rotational speed detecting means for detecting the rotational speed of the engine; and cooling fan control means for controlling the rotational speed of the hydraulic motor on the basis of the detection values of the first, second and third temperature detecting means and the rotational speed detecting means so that the rotational speed of the cooling fan is increased as any one of the temperature of the engine coolant, the hydraulic fluid of the working hydraulic system and the operating oil of the torque converter increases and the increase of the rotational speed of the cooling fan is limited not to exceed a limiting value that increases as the rotational speed of the engine increases when the travel acceleration in which the rotational speed of the engine increases is performed by operating the acceleration pedal; and said cooling fan control means controls the rotational speed of the hydraulic motor such that the rotational speed of the cooling fan decreases to a lowest rotational speed regardless of the temperature of the engine coolant, the hydraulic fluid of the working hydraulic system and the operating oil of the torque converter when the acceleration pedal is not operated and the rotational speed of the engine decreases to said low-speed idling speed.

9. A cooling fan drive system for a travel type working machine including an engine, an acceleration pedal for instructing a target engine rotational speed of said engine, a cooling fan for cooling an engine coolant, a hydraulic pump driven by said engine, and a hydraulic motor actuated by a hydraulic fluid delivered by the hydraulic pump for rotating the cooling fan, wherein said cooling fan drive system comprises:

engine speed control means for controlling a rotational speed of said engine such that the rotational speed of the engine decreases to a low-speed idling speed when said acceleration pedal is not operated and the rotational speed of the engine increases from said low-idling speed to a maximum rotational speed in accordance with an operation amount of the acceleration pedal when the acceleration pedal is operated;

temperature detecting means for detecting the temperature of the engine coolant;

first engine speed detecting means for detecting the target rotational speed of the engine;

second engine speed detecting means for detecting the actual rotational speed of the engine; and cooling fan control means for controlling the rotational speed of the hydraulic motor on the basis of the detection values of the temperature detecting means and the first and second engine speed detecting means so that the rotational speed of the cooling fan is increased as the temperature of the engine coolant rises up and the increase of the rotational speed of the cooling fan is limited not to exceed a limiting value that is lowered as the rotational speed difference between the target rotational speed and the actual rotational speed of the engine increases when the travel acceleration in which the rotational speed of the engine increases is performed by operating the acceleration pedal; and said cooling fan control means controls the rotational speed of the hydraulic motor such that the rotational speed of the cooling fan decreases to a lowest rotational speed regardless of the temperature of the engine coolant, when the acceleration pedal is not operated and the rotational speed of the engine decreases to said low-speed idling speed.

10. The cooling fan drive device for the travel type working machine according to claim 9, wherein the cooling fan control means calculates the fan target rotational speed that increases as the temperature of the engine coolant increases, calculates the limiting value of the fan target rotational speed that is lowered as the rotational speed difference between the target rotational speed and the actual rotational speed of the engine increases, corrects the fan target rotational speed so that the fan target rotational speed does not exceed the limiting value, and controls the rotational speed of the hydraulic motor so as to achieve the corrected fan target rotational speed.

11. The cooling fan drive device for the travel type working machine according to claim 9, wherein the hydraulic pump is a variable displacement hydraulic pump, and the cooling fan control means controls the rotational speed of the hydraulic motor by controlling the delivery capacity of the hydraulic pump.

12. The cooling fan drive device for the travel type working machine according to claim 9, wherein the hydraulic motor is a variable displacement hydraulic motor, and the cooling fan control means controls the rotational speed of the hydraulic motor by controlling the delivery capacity of the hydraulic motor.

13. The cooling fan drive device for the travel type working machine according to claim 9, further comprising a bypass circuit that is branched from a hydraulic fluid supplying line for supplying the hydraulic fluid delivered by the hydraulic pump to the hydraulic motor and connects the hydraulic fluid supplying line to a tank, wherein the cooling fan control means controls the rotational speed of the hydraulic motor by controlling a bypass flow rate flowing in the bypass circuit.

* * * * *